US006485118B2

(12) United States Patent
Matus, Jr.

(10) Patent No.: US 6,485,118 B2
(45) Date of Patent: Nov. 26, 2002

(54) ADJUSTABLE FOOD GUARD APPARATUS

(76) Inventor: Jose Orlando Matus, Jr., 2579 Drew Valley Rd., Atlanta, GA (US) 30319

( * ) Notice: Subject to any disclaimer, the term of this patent is extended or adjusted under 35 U.S.C. 154(b) by 0 days.

(21) Appl. No.: 09/765,836

(22) Filed: Jan. 19, 2001

(65) Prior Publication Data

US 2002/0096976 A1 Jul. 25, 2002

(51) Int. Cl.[7] ..... A47F 9/00; A47B 96/18
(52) U.S. Cl. ..... 312/137; 312/140.4
(58) Field of Search ..... 312/114, 116, 312/137, 236, 140.4, 313, 231, 322, 323; 108/1, 6, 8; 248/222.51, 225.11, 225.21, 371

(56) References Cited

U.S. PATENT DOCUMENTS 2,486,966 A * 11/1949 Mitchell ..... 312/313 X
3,404,930 A * 10/1968 Cafiero et al. ..... 312/313 X
3,921,539 A * 11/1975 Berger ..... 108/8
5,213,401 A * 5/1993 Hatcher ..... 312/322 X
5,306,077 A * 4/1994 Trevaskis ..... 312/323 X
5,584,545 A * 12/1996 LaVaute et al. ..... 312/137 X
6,132,018 A * 10/2000 McGrath ..... 312/140.4

OTHER PUBLICATIONS

Advertisement Brochure—Z Guard, Brass Smith Incorporated, 1999, pp. 1–4.

* cited by examiner

*Primary Examiner*—James O. Hansen
(74) *Attorney, Agent, or Firm*—Thomas, Kayden, Horstemeyer & Risley, LLP

(57) ABSTRACT

An apparatus and method of using an adjustable food guard. The method and apparatus include a food serving station that further includes a food serving device and an adjustable food guard apparatus. The food guard apparatus includes at least one adjustable bracket that includes a bracket slot, wherein the bracket slot includes at least one lock slot. In addition, the food guard apparatus includes at least one of vertical-mounting member that includes a plurality of pivot pins, where the pivot pins are capable of engaging the bracket. Also, the bracket is capable of adjustment from a first position into at least one second position using the pivot pins. The pivot pins are capable of engaging the bracket via the bracket slot. Further, the pivot pins are capable of sliding within the bracket slot and the pivot pins are capable of reversibly locking into the second position using the lock slot.

4 Claims, 4 Drawing Sheets

ADJUSTABLE FOOD GUARD APPARATUS

TECHNICAL FIELD

The present invention is generally related to food service stations and, more particularly, is related to food service stations that have an adjustable food guard that has moveable and rotatable brackets.

BACKGROUND OF THE INVENTION

Generally, a food guard is used to protect food that is to be served from a food service station. The food guard protects the food from contamination from the breath of customers that are requesting or self-serving food from a fast food bar, cafeteria food bar, or other similar food bar. Generally, a food service station includes a food service line or counter that includes some or all of the following: hot or cold food pans, soup wells, chafing dishes, and a breath protection device or sneeze guard. The food guard is typically attached to the food service counter. The food guard is positioned to protect the food from airborne bacteria, contaminants, the breath, sneeze, or cough of customers. The food guard has a transparent shield made of glass or other material, which is attached to a support structure. The shield can be moved into various positions to ensure protection of the food, while also allowing the necessary accessibility.

In order for a food guard to be effective, it must intersect what is considered the "breath zone". This zone is determined by 1) constructing an imaginary vertical line from the front edge of a serving counter up to a height of about 4'-6" and about 5'-6" from the floor and 2) constructing an imaginary line from the 4'-6" intersection to the front edge of the food zone and 3) constructing an imaginary line from the 5'-6" height to the rear edge of the food zone. The food zone is the area that exposed food will be displayed—generally a food pan, soup well, chafing dish, or similar device that is set back about 3" to about 6" from the front edge of the counter. A glass shield must intersect the breath zone in order to prevent the contamination of food from airborne bacteria from the breath of customers.

In general, food guards are used for different applications in a number of different circumstances. One circumstance involves using the food guard in an attendant-serving mode. In this mode, the customer is restricted from being able to touch or reach the food by way of a transparent shield, which can be in any of a multiple of configurations. However, the attendant can hand the food to the customer over the top of the food guard or under the guard if there is enough clearance between the food guard and the counter of the food serving device. Another circumstance in which a food guard can be used is in a self-serve mode. Here, the shield of the food guard is angled or positioned so that a customer can serve himself food through the clearance between the shield and the food service device. The shield still provides protection from contamination from the breath of the customer because it is positioned so as to intersect the "breath zone." The angle of the shield may need to be varied depending on the position of the food in the food serving station and the customer. Food that is farther away from the customer requires sufficient clearance between the shield and the food service station to enable access to the food. Therefore, depending on the circumstance, more or less clearance may be needed to allow accessibility, while maintaining "breath zone" coverage. In addition, different degrees of accessibility are often needed from meal to meal and from event to event thereby requiring a food guard that is adjustable.

Generally, the shield of currently used food guards are in a fixed non-adjustable position (e.g., in the vertical or angled position). The disadvantage to this arrangement is that different types of food guards are required for different serving circumstances, thereby increasing costs considerably. However, other food guards have shields that are adjustable into different positions. Generally, in order to rotate the shield these types of food guards require the operator to loosen a plurality of mechanical fasteners. While the fasteners are in the loosened state, the operator or another must support the shield so it does not fall. When the shield is positioned at the required angle the fasteners must be tightened. This process often requires two operators to adjust the angle of the shield (e.g., one operator holding the shield while the second operator is adjusting the fasteners), thereby requiring more man-power, slowing the process, and increasing costs. In addition, the shield must be positioned properly to protect the food and the aforementioned food guards do not lend themselves to easy positioning.

Thus, a heretofore unaddressed need exists in the industry to address the aforementioned deficiencies and inadequacies.

SUMMARY OF THE INVENTION

The present invention provides an apparatus and method of using an adjustable food guard. One embodiment of the present invention provides a food serving station that includes a food serving device and an adjustable food guard apparatus. The food guard apparatus includes at least one adjustable bracket that includes a bracket slot, wherein the bracket slot includes at least one lock slot. In addition, the food guard apparatus includes at least one of vertical-mounting member that includes a plurality of pivot pins, where the pivot pins are capable of engaging the bracket. Also, the bracket is capable of adjustment from a first position into at least one second position using the pivot pins. The pivot pins are capable of engaging the bracket via the bracket slot. Further, the pivot pins are capable of sliding within the bracket slot and the pivot pins are capable of reversibly locking into the second position using the lock slot.

Another embodiment of the present invention provides an adjustable food guard apparatus. The adjustable food guard apparatus includes at least one bracket that includes a bracket slot, wherein the bracket slot includes at least one lock slot. In addition, the food guard apparatus includes at least one vertical-mounting member, which includes a plurality of pivot pins. The pivot pins are capable of engaging the bracket. The bracket is capable of adjustment from a first position into at least one second position using the pivot pins. The pivot pins are capable of engaging the bracket via the bracket slot. In addition, the pivot pins are capable of sliding within the bracket slot. The pivot pins are capable of reversibly locking into the second position using the lock slot.

A further embodiment provides a method of converting a food service station from an attendant-serving food station to a self-serving food station. The method includes providing an adjustable food guard apparatus that can be moved from a vertical position to an angled position. The adjustable food guard apparatus includes a first bracket that includes a first bracket slot. The first bracket slot includes at least one first lock slot. In addition, the adjustable food guard apparatus includes a first vertical-mounting member. The first vertical-mounting member includes a plurality of first pivot pins that are capable of engaging the first bracket. The first bracket is capable of adjustment from the vertical position into at least one second position using the first pivot pins, which are capable of engaging the first bracket via the first bracket slot. The first pivot pins are capable of sliding within the first bracket slot and are capable of reversibly locking into the angled position using the first lock slot. The adjustable food guard apparatus also includes a second bracket. The second bracket includes a second bracket slot, where the second bracket slot includes at least one second lock slot. In addition, the adjustable food guard apparatus includes a second vertical-mounting member. The vertical-mounting member includes a plurality of second pivot pins that are capable of engaging the second bracket. The second bracket is capable of adjustment from the vertical position into at least one second position using the second pivot pins. The pivot pins are capable of engaging the second bracket via the second bracket slot. The second pivot pins are capable of sliding within the second bracket slot and the second pivot pins are capable of reversibly locking into the angled position using the second lock slot. The adjustable food guard apparatus also includes a shield that is engaged to the first bracket and the second bracket. The adjustable food guard apparatus is moved from the vertical position by moving the adjustable food apparatus in the upward direction and sliding the first bracket via the first bracket slot along the first pivot pin of the first vertical-mounting member. This is done so that the first pivot pin is engaged with the first lock slot and sliding the second bracket via the second bracket slot along the second pivot pin of the second vertical-mounting member so that the second pivot pin is engaged with the second lock so that the adjustable food guard apparatus is in the angled position.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention provides an apparatus and method of using an adjustable food guard. The present invention overcomes the disadvantages discussed above for at least the reason that the present invention does not have mechanical fasteners that need to be loosened and tightened to adjust the food guard and that the food guard can be adjusted from the attendant-serve mode to a self-serve mode by one operator. In general, an embodiment of the present invention includes a plurality of adjustable brackets, one or more of vertical-mounting members, and a shield. In a preferred embodiment, the apparatus includes a pair of adjustable brackets, a pair of vertical mounting members, and a shield. The vertical-mounting members are attached to a food-serving device. The adjustable brackets are attached to the vertical-mounting member, while the shield is attached to the adjustable brackets. The position of the shield can be adjusted into a plurality of positions ranging from zero to ninety degrees, relative to the vertical-mounting member using the adjustable bracket and vertical-mounting member.

Figure 1A:
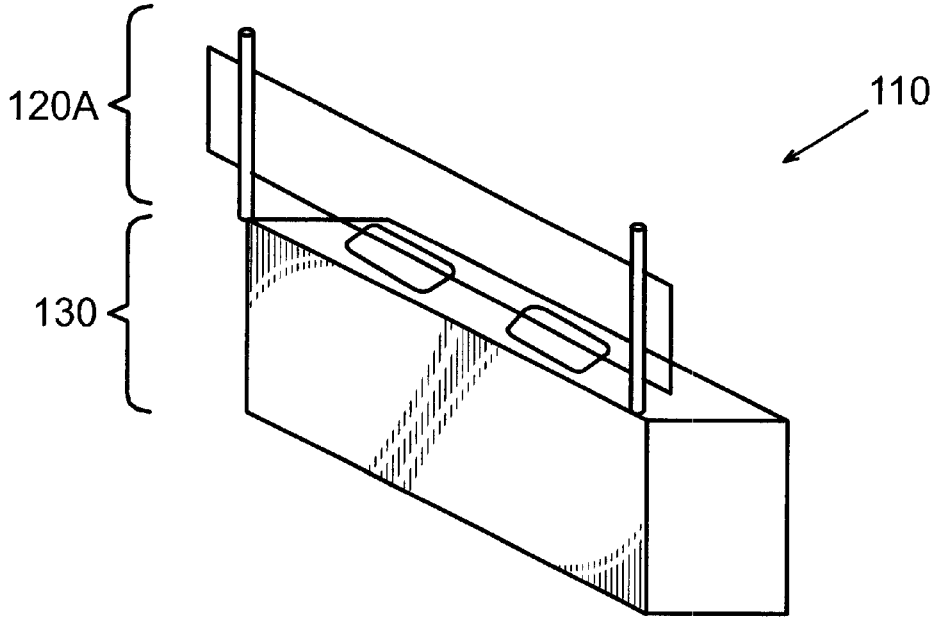
FIGS. 1A and 1B are perspective views of an embodiment of the adjustable food guard attached to a food service station.
Figure 1B:
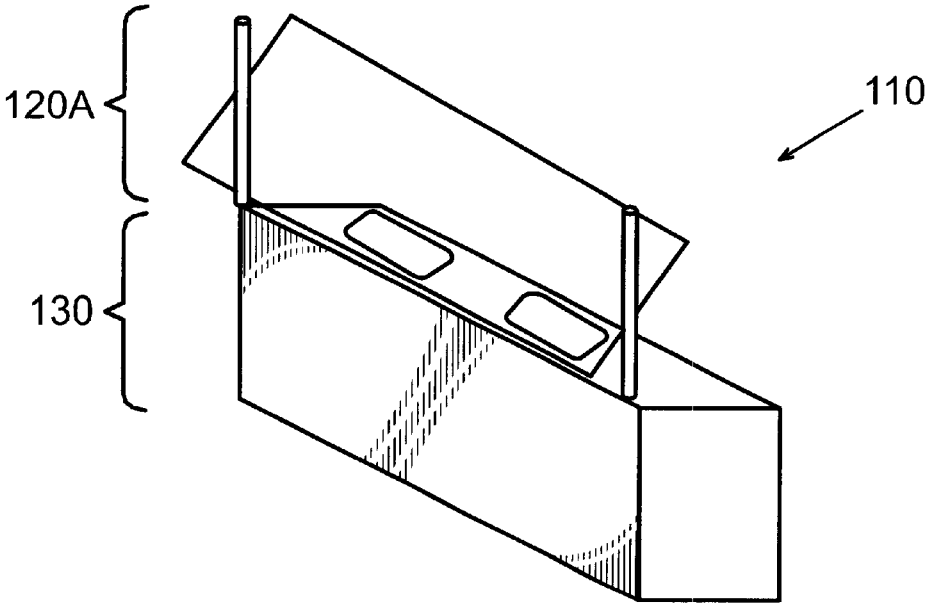

FIGS. 1A and 1B illustrate a perspective of an embodiment of the present invention. FIG. 1A illustrates a food service station 110 that has an adjustable food guard 120A and a food serving device 130. As can be seen, the food guard 120A is in the vertical position, or attendant-serving position, and substantially precludes the customers from accessing the food on the food service station 110. In addition, the food guard 120A substantially precludes bacteria and other contaminants originating from the breath of the customer from impinging upon the food by providing a barrier between the customer and the food. The customer can see the food and/or food preparation and can be handed the requested food from over the food guard 120A or under the food guard 120A, if there is enough clearance between the food guard 120A and food serving device 130.

FIG. 1B illustrates a complete food service station 110 that has the food guard 120B in an angled position, or self-serving position, with respect to the food serving device 130. The present invention provides for an apparatus and method of moving the food guard from the vertical position 120A to an angled position 120B. In this configuration, the customer can access the food and self-serve food from the food service station 110. The food guard 120B still substantially precludes bacteria and other contaminants originating from the customer from impinging upon the food by providing a barrier between the customer and the food. More specifically, the customer can see the food through the food guard 120B, but the food guard 120B still provides a barrier between the breath of the customer and the food.

Figure 2A:
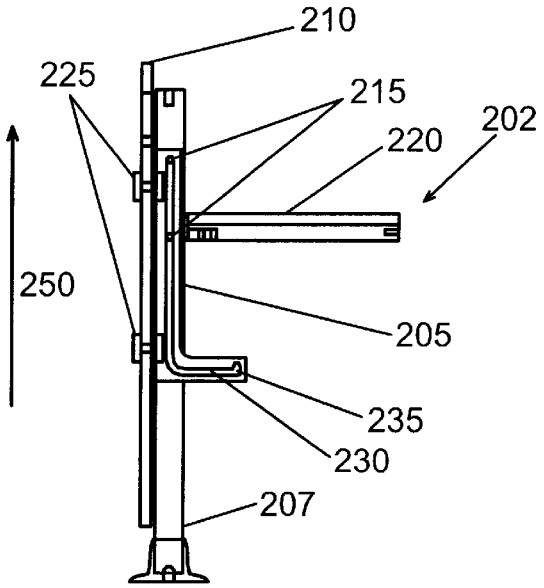
FIGS. 2A–2C illustrate cut out side views of an embodiment of the adjustable food guard as depicted in FIGS. 1A and 1B.
Figure 2B:
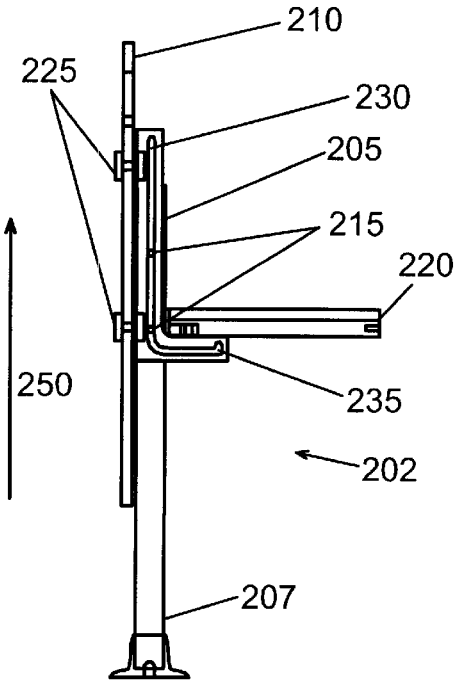
Figure 2C:
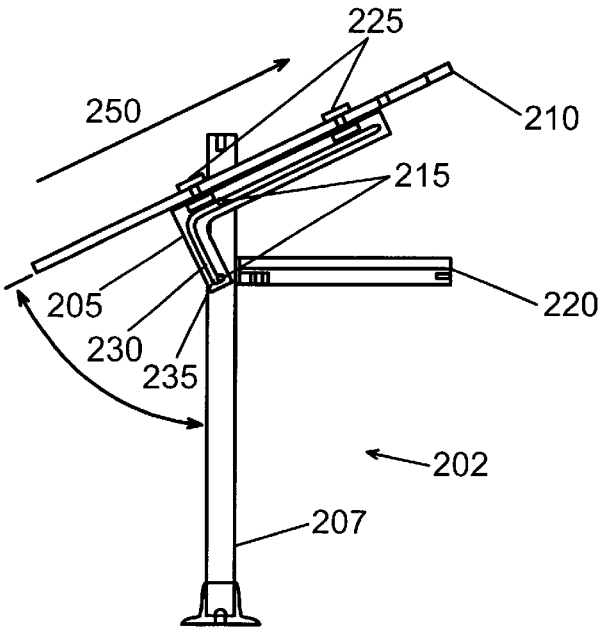

FIGS. 2A–2C illustrate a cut out view an embodiment of the present invention. FIGS. 2A–2C illustrate the movement of the various parts of an adjustable two-position food guard 202. The food guard 202 includes one or more adjustable brackets 205, one or more vertical-mounting members 207, and a shield 210. The preferred embodiment includes a pair of adjustable brackets 205, a pair of vertical-mounting members 207, and a shield 210. The shield 210 is attached to the adjustable bracket 205 via a plurality of shield attachments 225. The shield 210 is constructed of any transparent material. A non-limiting illustrative example of the materials that the shield 210 can be constructed of includes, but is not limited to, glass, tempered glass, plexiglass, plastic, or other transparent material. The adjustable bracket 205 and vertical-mounting member 207 can be constructed of materials that include, but are not limited to, metal, aluminum, plastic, or other appropriate material. The adjustable bracket 205 engages the vertical-mounting member 207 by way of one or more pivot pins 215. More specifically, the pivot pins 215 engage the adjustable bracket 205 through one or more bracket slots 230. The pivot pins 215 are attached to the vertical-mounting member 207 through the bracket slot 230, thereby engaging the adjustable bracket 205 to the vertical-mounting member 207. The pivot pins 215 are intended to include any device that is adapted to move within the bracket slot 230, such as, but not limited to, screws, nails, bolts, or other similar devices. Generally, the bracket slot 230 has one or more locking slots 230, which can be reversibly engaged with the pivot pins 215 to secure the shield 210 in a particular position, e.g., vertical or angled position. In a preferred embodiment, the bracket slot 230 has a locking slot 235 at one end of the bracket slot 230 that can be reversibly engaged with the pivot pins 215. The adjustable bracket 205 can slid 250 along the pivot pins 215, which are engaged to the adjustable bracket 205 via the bracket slots 230, into the desired position and locked into position by the locking slot 235. A non-limiting illustrative example of a locking slot 235 is an extension of the bracket slot 230 positioned such that a pivot pin is secured therein. The weight of the shield 210 secures the pivot pin in the locking slot 235. However, little effort is required by a single operator to move the shield 210 such that the pivot pin is not secured in the locking slot 235, thereby facilitating easy adjustment from one position to another by a single operator.

FIG. 2B illustrates the adjustable bracket 205 after it has been moved 250 along the pivot pins 215 of the vertical-mounting member 207 in an upward direction. FIG. 2C illustrates the adjustable bracket 205 after a pivot pin has been reversibly locked into position in the locking slot 235. More specifically, the adjustable bracket 205 slides 250 along the pivot pins 215, where the pivot pins 215 are engaged to the adjustable bracket 205 through the bracket slot 230. The locking slot 235 slides into a position such that a pivot pin, typically the lower pivot pin, is secured in the locking slot 235 so that the shield 210 is in an angled position. The locking slot 235 can be disengaged from the pivot pin and the shield 210 can slid 250 into the vertical position, as depicted in FIG. 2A.

The bracket slot 230 can be curved to obtain the desired shield angle 255. The resultant shield angle 255 is any appropriate angle ranging from zero to ninety degrees relative to the vertical-mounting member 207 (zero degrees corresponds to the shield in the vertical position); a preferred embodiment set the shield 210 at about a thirty-degree angle. The bracket slot 230 can have one or more locking slots 235 to enable the food guard 202 to be positioned at multiple angles; a preferred embodiment illustrated in FIGS. 2A and 2B uses one locking slot 235.

The vertical-mounting member 207 includes attachment points for a shelf support 220, as depicted in FIGS. 1A–1C. In addition, the vertical-mounting member 207 includes attachment points for multiple adjustable brackets. This feature allows different types of brackets (e.g. a two-position bracket and a four-position bracket) to be mounted upon the same vertical-mounting member 207. Thus, side by side food stations can have food guards 202 at different positions for variable accessibility. More particularly, a single vertical-mounting member 207 could have one type of adjustable bracket on one side of the vertical-mounting member 207 and a different type of adjustable bracket on the other side of the vertical-mounting member 207. Further, the vertical-mounting member 207 includes attachment points for engagement to a food serving device. The vertical-mounting member 207 can be attached to the food serving device at the base, top, or side of the vertical-mounting member 207. Additional attachment points are included on the vertical-mounting member 207 for other components, such as, but not limited to, a utensil holder, lighting system, a sign hanging system, food heating system, ventilation system, electrical outlets, and the like.

FIGS. 3A–3D illustrate a cut out view of an embodiment of the present invention. FIGS. 3A–3D illustrate the movement of the various parts of an adjustable four-position food guard 302. The food guard 302 includes an adjustable bracket 305, a vertical-mounting member 307, and a shield 310. The shield 310 is attached to the adjustable bracket 305 via a plurality of shield attachments 325. The adjustable bracket 305 engages the vertical-mounting member 307 by way of a plurality of pivot pins 315. More specifically, the pivot pins 315 engage the adjustable bracket 305 through one or more bracket slots 330. The pivot pins 315 are attached to the vertical-mounting member 307 through the bracket slot 330. In a preferred embodiment, the bracket slot 330 has three locking slots 335A–335C that can be reversibly engaged with the pivot pins 315. In a preferred embodiment, locking slot 335A is at about a thirty degree angle, while locking slot 335B and 335C are at about forty-five and about sixty degree angles, respectively. The adjustable bracket 305 can slid 350 along the pivot pins 315 into the desired position and locked into position by the locking slot 335A–C.

Figure 3A:
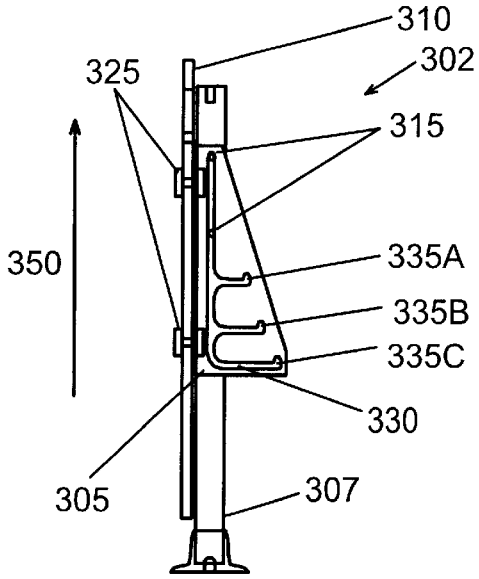
FIGS. 3A–3D illustrate cut out side views of an embodiment of the adjustable food guard depicted in FIGS. 1A and 1B.
Figure 3B:
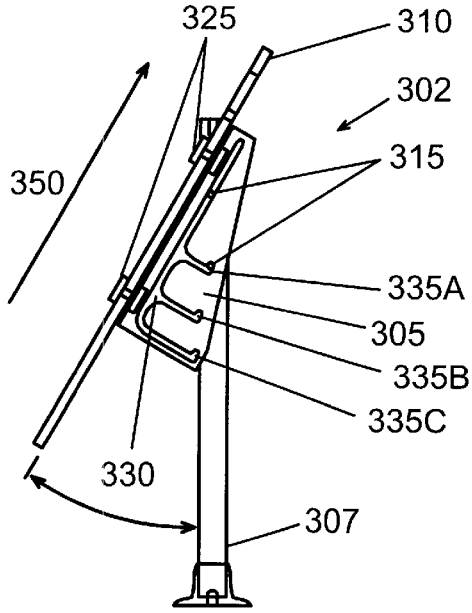

FIG. 3B illustrates the food guard after it has been moved 350 into a locked position using locking slot 335A. More specifically, the adjustable bracket 305 slides 350 along the pivot pins 315, where the pivot pins 315 are engaged to the adjustable bracket 305 through the bracket slot 330. The locking slot 335A slides into a position such that a pivot pin, typically the lower pivot pin, is secured in the locking slot 335A so that the shield 310 is in an angled position. A non-limiting illustrative example of the angle of the shield 310 that can be produced by using locking slot 335A (depicted in FIG. 3B) is about thirty degrees, but any other appropriate angle could be used. The locking slot 335A can be disengaged from the pivot pin and the shield 310 slid 350 into the vertical position, as depicted in FIG. 3A, or into another angled position, as depicted in FIGS. 3C and 3D.

Figure 3C:
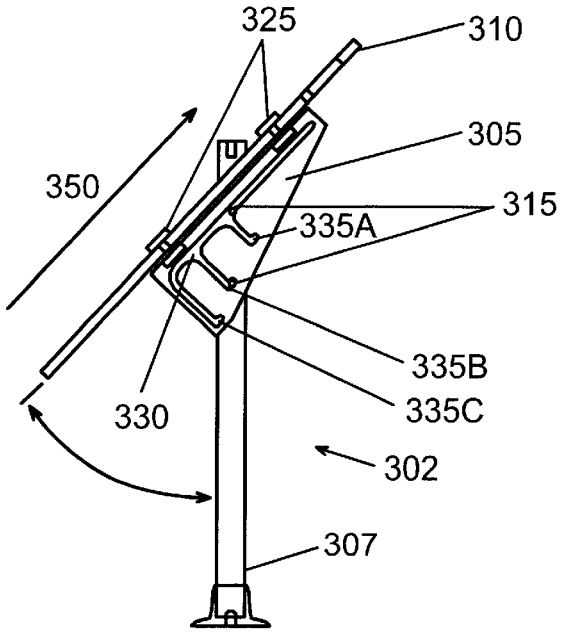

FIG. 3C illustrates the food guard 302 guard after it has been moved 350 into a locked position using locking slot 335B. More specifically, the adjustable bracket 305 slides 350 along the pivot pins 315, where the pivot pins 315 are engaged to the adjustable bracket 305 through the bracket slot 330. The locking slot 335B slides into a position such that a pivot pin, typically the lower pivot pin, is secured in the locking slot 335B so that the shield 310 is in an angled position. A non-limiting illustrative example of the angle of the shield 310 that can be produced by using locking slot 335B (depicted in FIG. 3C) is about forty-five degrees, but any other appropriate angle could be used. The locking slot 335B can be disengaged from the pivot pin and the shield 310 slid 350 into the vertical position, as depicted in FIG. 3A, or into another angled position, as depicted in FIGS. 3B and 3D.

Figure 3D:
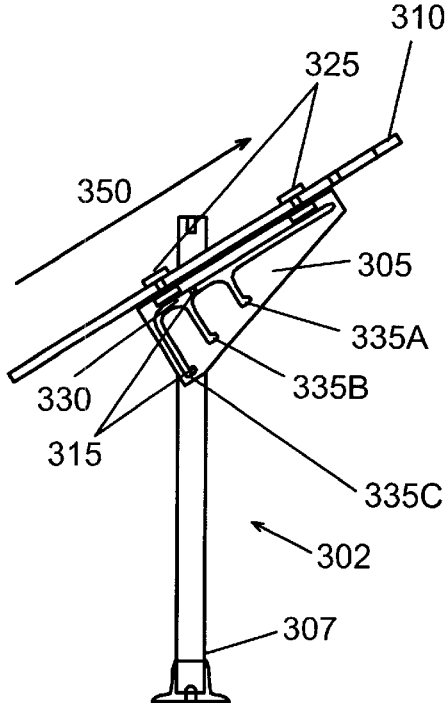

FIG. 3D illustrates the food guard 302 guard after it has been moved 350 into a locked position using locking slot 335C. More specifically, the adjustable bracket 305 slides 350 along the pivot pins 315, where the pivot pins 315 are engaged to the adjustable bracket 305 through the bracket slot 330. The locking slot 335C slides into a position such that a pivot pin, typically the lower pivot pin, is secured in the locking slot 335C so that the shield 310 is in an angled position. A non-limiting illustrative example of the angle of the shield 310 that can be produced by using locking slot 335C (depicted in FIG. 3D) is about sixty degrees, but any other appropriate angle could be used. The locking slot 335C can be disengaged from the pivot pin and the shield 310 slid 350 into the vertical position, as depicted in FIG. 3A, or into another angled position, as depicted in FIGS. 3B and 3C.

The bracket slot 330 can be curved to obtain one or more desired shield angles, e.g., 360, 370, and 380. The resultant shield angle is any appropriate angle ranging from zero to ninety degrees relative to the vertical-mounting member 207 (zero degrees corresponds to the shield in the vertical position); a preferred embodiment provides for securing the shield 310 at three angles, which are about thirty, forty-five, and sixty degree angles. The bracket slot 330 can have one or more locking slots 335A–335C to enable the food guard 302 to be positioned at multiple angles; a preferred embodiment provides for three locking slots 335A–335C.

The vertical-mounting member 307 includes attachment points for a shelf support. In addition, the vertical-mounting member 307 includes attachment points for multiple adjustable brackets. This feature allows different types of adjustable brackets (e.g. a two-position bracket and a four-position bracket) to be mounted upon the same vertical-mounting member 307. Thus, side by side food stations can have food guards 302 at different positions (angles) for variable accessibility. Further, the vertical-mounting member 307 includes attachment points for attachment to a food serving device. The vertical-mounting member 207 can be attached to the food serving device at the base, top, or side of the vertical-mounting member 207. Additional attachment points are included on the vertical-mounting member 307 for other components, such as, but not limited to, a utensil holder, lighting system, a sign hanging system, food heating system, ventilation system, electrical outlets, and the like.

Figure 4A:
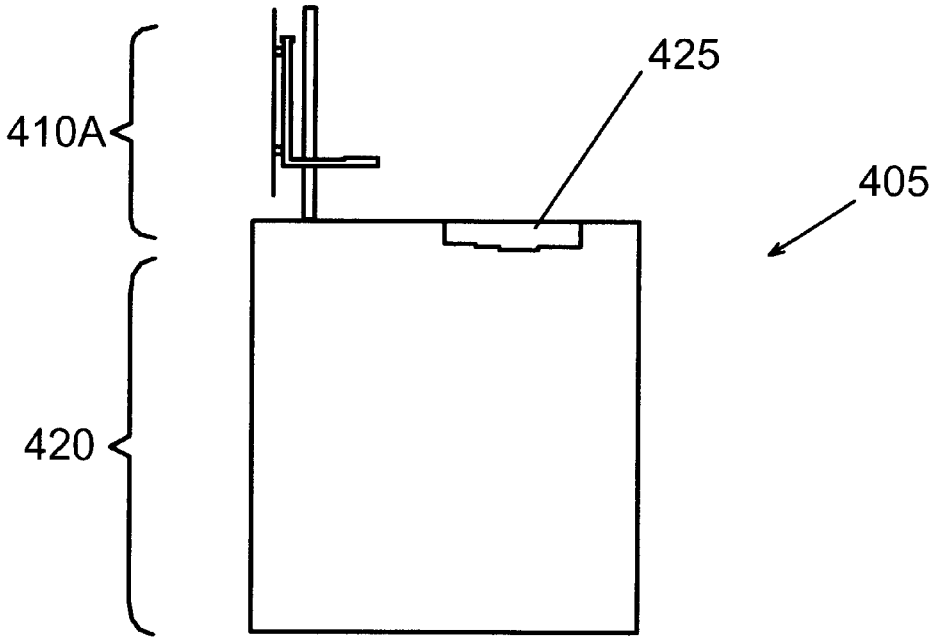
FIGS. 4A and 4B are cut out side views of an embodiment of the adjustable food guard attached to a food service station as depicted in FIGS. 2A–2C and 3A–3D.
Figure 4B:
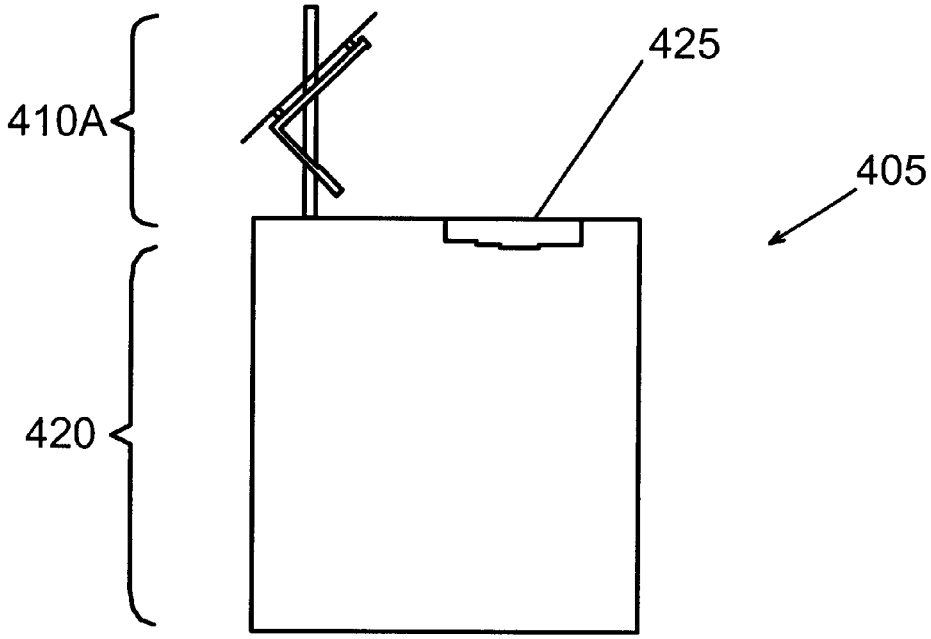

FIGS. 4A and 4B illustrate a complete food service station 405 that has a food guard 410A and 410B that is attached to a food serving device 420. As can be seen in FIG. 4A, the food guard 410A is in the vertical position and protects the food 425 from customer contamination. In FIG. 4B, the food guard 410B is in an angled position. The angled position allows the customer to access the food 425 for self-service or allows an attendant to give the food 425 to the customer under the food guard 410B. In addition, the food guard 410B, at this angle, is protecting the food from contamination from the breath of the customer.

It should be emphasized that the above-described embodiments of the present invention, particularly, any "preferred" embodiments, are merely possible examples of implementations, merely set forth for a clear understanding of the principles of the invention. Many variations and modifications may be made to the above-described embodiment(s) of the invention without departing substantially from the spirit and principles of the invention. All such modifications and variations are intended to be included herein within the scope of this disclosure and the present invention and protected by the following claims.

Therefore, having thus described the invention, at least the following is claimed:

1. A food service station capable of adjusting from an attendant-serving food station to a self-serving food station and adjusting back to an attendant-serving food station comprising:

a means for moving an adjustable food guard apparatus from a vertical position to an angled position, the adjustable food guard apparatus having a first bracket, a first vertical-mounting member, a second bracket, a second vertical-mounting member, and a shield that is engaged to said first bracket and said second bracket, wherein said first bracket includes a first bracket slot that includes at least one first lock slot, and wherein said first vertical-mounting member has a plurality of first pivot pins that are capable of engaging said first bracket slot, and wherein said second bracket has a second bracket slot that includes at least one second lock slot, and wherein said second vertical-mounting member has a plurality of second pivot pins that are capable of engaging second bracket slot, and wherein said adjustable food guard apparatus is moved from said vertical position by moving said adjustable food apparatus in the upward direction thereby causing said first pivot pin to slide along said first bracket slot until said first pivot pin is engaged with said first lock slot and thereby causing said second pivot pin to slide along said second bracket slot until said second pivot pin is engaged with said second lock slot.

2. An adjustable food guard apparatus capable of adjusting from an attendant-serving food station to a self-serving food station comprising:

a means for providing a first bracket, wherein said first bracket includes a first bracket slot that includes at least one first lock slot;

a means for providing a first vertical-mounting member, wherein said first vertical-mounting member has a plurality of first pivot pins that are capable of engaging said first bracket slot;

a means for providing a second bracket, wherein said second bracket has a second bracket slot that includes at least one second lock slot;

a means for providing a second vertical-mounting member, wherein said second vertical-mounting member has a plurality of second pivot pins that are capable of engaging second bracket slot; and a means for providing a shield that is engaged to said first bracket and said second bracket, and wherein said adjustable food guard apparatus is moved from a vertical position by moving said adjustable food apparatus in the upward direction thereby causing said first pivot pin to slide along said first bracket slot until said first pivot pin is engaged with said first lock slot and thereby causing said second pivot pin to slide along said second bracket slot until said second pivot pin is engaged with said second lock slot.

3. A method of converting a food service station from an attendant-serving food station to a self-serving food station comprising the steps of:

moving an adjustable food guard apparatus from a vertical position to an angled position, the adjustable food guard apparatus having a first bracket, a first vertical-mounting member, a second bracket, a second vertical-mounting member, and a shield that is engaged to said first bracket and said second bracket, wherein said first bracket includes a first bracket slot that includes at least one first lock slot, and wherein said first vertical-mounting member has a plurality of first pivot pins that are capable of engaging said first bracket slot, and wherein said second bracket has a second bracket slot that includes at least one second lock slot, and wherein said second vertical-mounting member has a plurality of second pivot pins that are capable of engaging second bracket slot, and wherein said adjustable food guard apparatus is moved from said vertical position by moving said adjustable food apparatus in the upward direction thereby causing said first pivot pin to slide along said first bracket slot until said first pivot pin is engaged with said first lock slot and thereby causing said second pivot pin to slide along said second bracket slot until said second pivot pin is engaged with said second lock slot.

4. A method of converting an adjustable food guard apparatus from an attendant-serving food station to a self-serving food station comprising the steps of:

providing a first bracket, wherein said first bracket includes a first bracket slot that includes at least one first lock slot;

providing a first vertical-mounting member, wherein said first vertical-mounting member has a plurality of first pivot pins that are capable of engaging said first bracket slot;

providing a second bracket, wherein said second bracket has a second bracket slot that includes at least one second lock slot;

providing a second vertical-mounting member, wherein said second vertical-mounting member has a plurality of second pivot pins that are capable of engaging second bracket slot; and providing a shield that is engaged to said first bracket and said second bracket, and wherein said adjustable food guard apparatus is moved from a vertical position by moving said adjustable food apparatus in the upward direction thereby causing said first pivot pin to slide along said first bracket slot until said first pivot pin is engaged with said first lock slot and thereby causing said second pivot pin to slide along said second bracket slot until said second pivot pin is engaged with said second lock slot.

* * * * *